US006507820B1

(12) United States Patent
Deutgen

(10) Patent No.: US 6,507,820 B1
(45) Date of Patent: Jan. 14, 2003

(54) SPEECH BAND SAMPLING RATE EXPANSION

(75) Inventor: Petra Deutgen, Lund (SE)

(73) Assignee: Telefonaktiebolaget LM Ericsson, Stockholm (SE)

( * ) Notice: Subject to any disclaimer, the term of this patent is extended or adjusted under 35 U.S.C. 154(b) by 203 days.

(21) Appl. No.: 09/609,795

(22) Filed: Jul. 3, 2000

(30) Foreign Application Priority Data

Jul. 6, 1999 (GB) ..... 9915831

(51) Int. Cl.[7] ..... G10L 21/04; G10L 11/04; G10L 19/14

(52) U.S. Cl. ..... 704/500; 704/206; 704/230

(58) Field of Search ..... 704/500–501, 704/205–226, 230; 375/300–320; 708/300–320; 455/550–570

(56) References Cited

U.S. PATENT DOCUMENTS

| | | | | |
|---|---|---|---|---|
| 4,835,791 A | * | 5/1989 | Daoud | 375/301 |
| 4,896,356 A | * | 1/1990 | Millar | 704/205 |
| 4,901,307 A | * | 2/1990 | Gilhousen et al. | 455/562 |
| 4,941,178 A | | 7/1990 | Chuang | 381/41 |
| 5,325,318 A | * | 6/1994 | Harris et al. | 708/313 |
| 5,406,635 A | * | 4/1995 | Jarvinen | 704/226 |
| 5,455,888 A | | 10/1995 | Iyengar et al. | 395/212 |
| 5,581,652 A | | 12/1996 | Abe et al. | 395/2.31 |

FOREIGN PATENT DOCUMENTS

| | | |
|---|---|---|
| EP | 0 696 110 A1 | 2/1996 |
| EP | 0 838 804 A2 | 4/1998 |
| EP | 1 008 984 A2 | 6/2000 |
| GB | 1 409 799 | 10/1975 |
| GB | 2 280 827 A | 2/1995 |

OTHER PUBLICATIONS

Karelic et al ("Compression Of High–Quality Audio Signals Using Adaptive Filterbanks And A Zero–Tree Coder", Convention of Electrical and Electronics Engineers in Israel, Mar. 1995).*

Ferreira ("A New Frequency Domain Approach To Time–Scale Expansion Of Audio Signals", IEEE International Conference on Acoustics, Speech and Signal Processing, May 1998).*

Liang et al ("Combining A Biconical With A Polarizer To Expand Bandwidth", Antennas and Propagation Society International Symposium, Jun. 1995).*

Crochiere et al ("Multirate Digital Signal Processing", Prentiss–hall © 1990).*

Yasukawa, H: "Spectrum Broadening of Telephone Band Signals Using Multirate Processing for Speech Quality Enhancement", *IEICE Transactions on Fundamentals of Electronics, Communications and Computer Sciences*, vol. E78–A No. 8, Aug. 1995, pp. 996–998.

Novelty Search performed by RWS Group of Tavistock House, Tavistock Square London WC1H 9LG, England on May 26, 1999.

Betts, John, Search Report for United Kingdom Patent Application No. GB 9915831.3, Dec. 21, 1999.

Soliman, Ahmed, International Search Report for International Patent Application No. PCT/EP00/05765, Sep. 29, 2000.

* cited by examiner

*Primary Examiner*—Richemond Dorvil
*Assistant Examiner*—Daniel A. Nolan
(74) *Attorney, Agent, or Firm*—Jenkens & Gilchrist P.C.

(57) ABSTRACT

The present-invention relates to a method for the band expansion of speech for telephones, in particular for mobile telephones, by increasing the effective sampling rate of the speech signal by the insertion of additional samples and subsequent filtering of the expanded bandwidth speech signal.

13 Claims, 2 Drawing Sheets

SPEECH BAND SAMPLING RATE EXPANSION

TECHNICAL FIELD OF THE INVENTION

The invention relates to the band expansion of speech for telephones, in particular for mobile telephones.

DESCRIPTION OF RELATED ART

FIG. 1 of the accompanying drawings is an exemplary illustration of a wide-band speech signal having a bandwidth of around 8 kHz. Although most of the information carried by the speech signal is contained in components of the speech signal having frequencies up to 4 kHz, as can be seen clearly from the diagram, nevertheless significant information is contained in components of the speech signal having frequencies in the range approximately 4–8 kHz.

An exemplary illustration of an equivalent narrowband speech signal having a bandwidth of around 4 kHz is also shown in FIG. 1.

The bandwidth of speech carried by the existing telephone system infrastructure is generally limited to around 4 kHz. Although speech signals having a bandwidth of 4 kHz are intelligible, the loss of the higher frequencies from the speech signal results in the speech produced by telephones sounding unnatural.

Many suggestions have been made previously to enhance the quality of speech signals in telephone systems by bandwidth expansion of the narrowband speech signal.

One conventional way of creating a wide-band speech signal from a narrowband speech signal relies on the characteristics of speech and uses pitch periodicity and the spectral envelope of the narrowband speech signal to estimate the pitch periodicity and the spectral envelope of the missing wide-band signals frequencies.

However, algorithms which estimate the pitch periodicity and the spectral envelope of the missing wide-band signals frequencies tend to introduce unwanted artefacts which reduce speech quality.

Spectrum expansion methods that utilise aliasing effects resulting from sampling rate conversion and subsequent digital filtering for spectrum shaping have also previously been proposed.

One example of this technique shows a narrowband speech signal sampled at 8 kHz is expanded by an interpolator with 16 kHz sampling. The resulting signal is fed to two parallel filter paths. In the first filter path the interpolated signal is filtered with a low pass filter to obtain the original input signal. In the second filter path the interpolated signal is filtered with a shaping filter to generate a signal in the frequency range 4–7 kHz. The signals resulting from the two parallel filter paths are then level adjusted and added together to obtain the desired wide-band signal.

However, although the circuit configuration used in this method is relatively simple when compared with the previously used methods based on estimates of the spectral envelope and periodicity of the speech signal, the method set out in this paper still involves extensive filtering and requires level adjustment of the signals in the different filter paths prior to the summation of the filtered samples from each path to obtain the wide-band output speech signal.

SUMMARY OF THE INVENTION

The prior art proposals to expand speech bandwidth for telephones have the drawback that they are fairly complex and computationally intensive. In addition prior art proposals which seek to estimate the higher band frequencies can introduce unwanted artefacts into the signal, therefore degrading the speech quality.

The present invention seeks to provide a method of expanding the speech bandwidth for telephones which provides improved speech quality when compared with the narrowband speech signal.

Embodiments of the method in accordance with the invention have the advantage that they can be implemented with low complexity.

DETAILED DESCRIPTION OF PREFERRED EMBODIMENT

Figure 1:
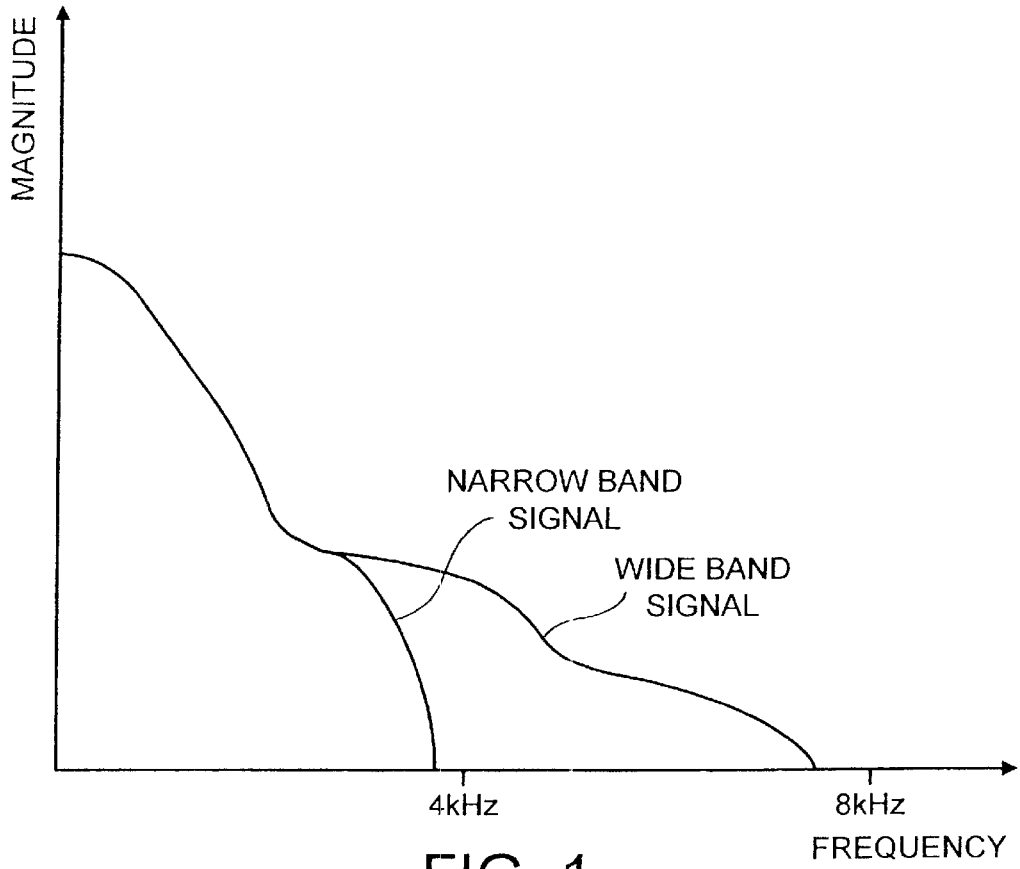
FIG. 1 (Prior Art)
FIG. 1 is an exemplary illustration of a wide-band speech signal and of a corresponding narrowband speech signal.

The present invention will now be described with reference to the drawings. In the drawings and description reference is made to a narrowband speech signal having a bandwidth of less than 4 kHz and a wide-band speech signal having a bandwidth of around 8 kHz. However, the invention is not limited to these specific frequencies and the method of the invention may be applied with other frequencies.

The method of the invention is now described with reference to FIGS. 2–4.

Essentially, in accordance with the method of the invention, the sampling rate of an input narrowband speech signal is doubled from 8 kHz to 16 kHz by inserting a zero sample between the input narrowband speech signal samples.

Figure 2:
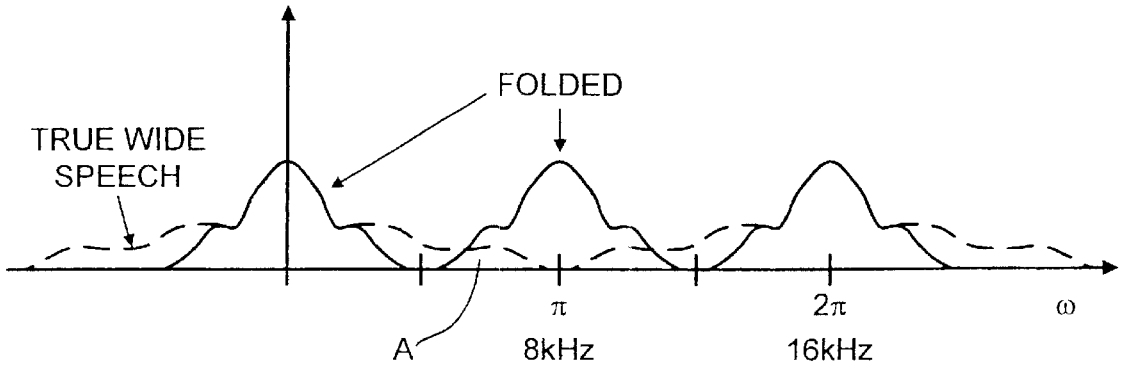
FIG. 2 illustrates the spectrum folding in the frequency domain in accordance with the invention.

A frequency domain representation of the resulting speech signal with samples at 16 kHz is shown in FIG. 2.

In order to better understand the invention, it should be noted, with reference to FIG. 2, that in the frequency domain the effect of the invention can be described by the following equations:

$$Ispeech(e^{j\omega})=FFT(ispeech(n))$$

$$\text{Folded}(e^{j\omega})=Ispeech(e^{j\omega})+Ispeech(e^{j(\omega-n)})$$

where:

ISpeech($e^{j\omega}$) represents the frequency spectrum of an input speech signal (sampled at 16 kHz);

FFT stands for Fast Fourier Transform;

ispeech(n) represents samples of the input narrowband speech signal (sampled at 16 kHz);

Folded($e^{j\omega}$) represents the frequency spectrum of the wide-band speech signal (sampled at 16 kHz).

In the time domain the same function can be written as:

$$\text{folded}(n)=ispeech(n)+(-11)^n*ispeech(n)$$

or:

$$\text{folded}(n)=2*ispeech(n)$$

where n even $$0$$

where n odd

This algorithm is simplified in accordance with the method of the invention by taking the original input speech sampled at 8 kHz and including zeros between the samples. This is exactly the same as first perfectly interpolating the speech to 16 kHz and then zeroing the odd samples.

That is:

$$\text{folded}(2n)=\text{speech}(n)$$

$$\text{folded}(2n+1)=0$$

Figure 3:
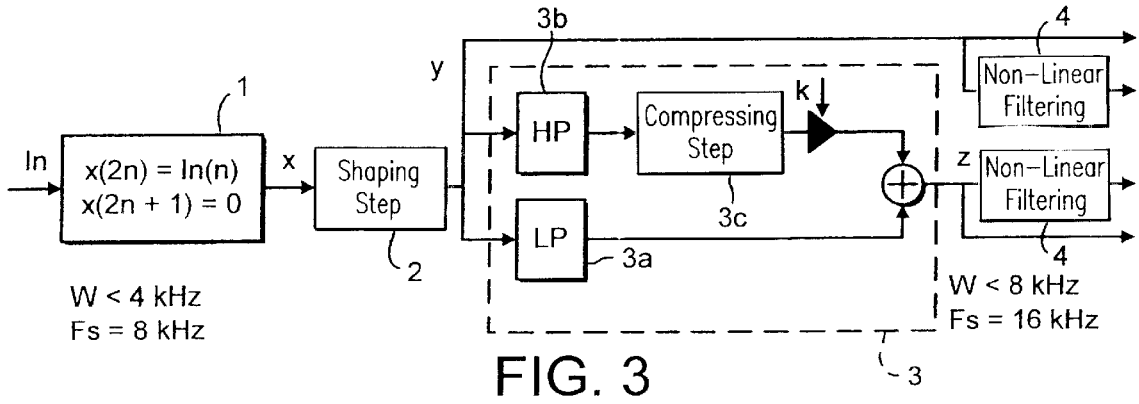
FIG. 3 shows a block diagram of the steps of the method of the invention.

Thus, as shown in FIG. 3, in accordance with step 1 of the method of the invention the samples of the original input speech (sampled at 8 kHz) are input and are interleaved with zero samples and the resulting signal is output as a wide-band speech signal having a sample rate of 16 kHz.

In accordance with step 2 of the method of the invention shown in FIG. 3, the resulting speech signal samples are then filtered to more closely correspond to a wide-band speech signal. This shape filtering shapes the spectrum of the wide-band signal to decrease with increasing frequency and is intended to ensure that the average behaviour of the estimated spectral envelope fits the average behaviour of the true wide band speech.

The shape filtering is preferably achieved by means of a low pass filter, and most preferably by means of a 20 taps FIR filter with a cut-off frequency at about 4 kHz.

Thus, in accordance with the method of the invention, the spectrum of the wide-band signal in the upper frequency range, i.e. in the frequency range 4–8 kHz, is effectively created firstly by the process of copying of the spectrum of the narrowband speech signal at lower frequencies, i.e. in the frequency range up to 4 kHz, caused by the interpolation of the narrowband signal (step 1 FIG. 3), and secondly by the shaping of the resulting spectrum by the shape filter (step 2 FIG. 3). This area of the frequency spectrum is labelled A in FIG. 2.

The speech signal y resulting from Step 2 of the method of the invention as shown in FIG. 3 is a wide-band speech signal having enhanced intelligibility when compared with the original narrowband speech signal.

In accordance with advantageous embodiments of the invention, the intelligibility of the wide-band speech signal y may be improved by compressing the wideband speech signal y as shown in step 3 of FIG. 3.

In step 3, shown in FIG. 3, the input signal y is applied to two filter paths. The speech signals resulting from the signal paths are combined to form the wide-band speech signal z output from step 3.

In the first filter path the input wide-band signal y is filtered in a low pass filter in step 3*a* to obtain a signal having a frequency spectrum approximating the frequency spectrum of the original narrowband input signal In, i.e. in the range 0–4 kHz, for example.

In the second filter path the input wide-band signal y is filtered in a high pass filter in step 3*b* to obtain the extended portion of the frequency spectrum of the wide-band'speech signal, i.e. frequencies in the range 4–8 kHz, for example.

It is not necessary for the low-pass and high-pass filters used insteps 3*a* and 3*b* to have cut-off frequencies at 4 kHz. In fact, other cut-off frequencies may be chosen.

This extended portion of the frequency spectrum is then compressed in the compressing step 3*c*, and the output of the compressing step 3*c* is multiplied by a factor k prior to being combined with the output of the first filter path to form the output signal z.

The operation of the compressing step 3*c* will be explained with reference to FIG. 4.

The output signal v of the compressing step 3*c* is first rectified in step 3*c*1 to obtain its magnitude and the resulting signal undergoes low pass filtering as shown in step 3*c*2. In step 3*c*3 a pivot point value PP is divided by the magnitude output from step 3*c*2 and resulting value is raised to the power of a factor "shape". Step 3*c*4 merely illustrates that if the rectified input value is less than the pivot point value PP, no alteration is made. The output of step 3*c*3 or 3*c*4 is then combined with the input signal.

Figure 4:
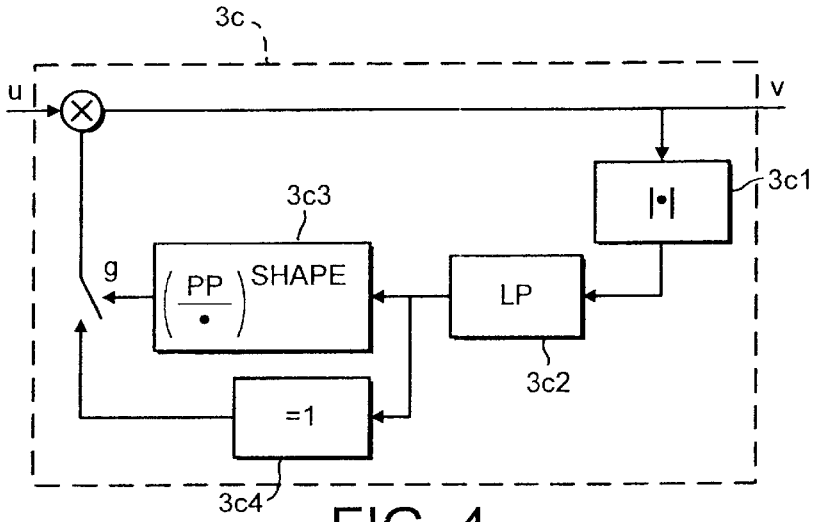
FIG. 4 is a block diagram of an exemplary compressing function.

The compression pictured in FIG. 4 can be written as:

$$\begin{cases} v = g*u & |u| \geq PP \\ v = u & |u| < PP \end{cases}$$

where u is the input to step 3*c*, v is the output of step 3*c* and g is the output of step 3*c*3.

For an input magnitude greater than or equal to the pivot point value PP, the output is approximately a constant times the root of the input signal, as shown in the following equations.

$$v = g*u \approx \left(\frac{PP}{v}\right)^{shape} *u$$

$$v^{(shape+1)} \approx PP^{shape} *u$$

$$v \approx \sqrt[shape+1]{PP^{shape}} * \sqrt[shape+1]{u}$$

Thus it can be seen that the effect of the compressing step 3*c* is that signals having a magnitude greater than PP are compressed, wherein the choice of the factor "shape" determines the amount of compression.

The low pass filter step is used to avoid fluctuations in the compression.

It has been found that the described arrangement is relatively insensitive to variations in the value of k. However, for an input speech signal normalised to a magnitude of 32768, an arrangement in which PP=150–200, Shape factor=4 and k=3 or 4 has been found to be satisfactory.

In order to better appreciate the effect of the advantageous embodiment of the method of the invention described with reference to Step 3 of FIG. 3, including Step 3*c* of FIG. 4, it is to be noted that in true wide band speech the spectral envelope changes over time depending on what is pronounced.

In particular, it should be noted that speech consists of both voiced and un-voiced sounds, which each have different spectrum characteristics. For example, in the word "as", the "a" sound is a voiced sound and the "s" sound is an unvoiced sound. The differences between the voiced and unvoiced sounds made when saying the word "as" will be used as an example in the following explanation of the operation of the compressing step in accordance with the invention.

When the word "as" is spoken, the spectral envelope of the wideband speech signal corresponding to the "a" sound will have a large magnitude at low frequencies and will decrease with frequency. In contrast, the spectral envelope of the wideband speech signal corresponding to the "s" sound will have a lower, but more constant, magnitude over the frequency range. Thus the spectral envelope of the voiced sound "a" is significantly larger than the spectral envelope of the unvoiced sound "s" in the lower frequency range while in the upper frequency range the amplitude of the spectral envelopes of the voiced and unvoiced sounds are more similar.

As outlined above, in accordance with the present invention, the narrowband speech at lower frequencies (i.e. up to 4 kHz) is copied to the upper band frequency range as a result of the interpolation of the narrowband speech signal carried out in step 1 of the invention as indicated in FIG. 3.

In view of the differences, outlined above, in the respective spectrum envelopes for voiced and unvoiced sounds, the interpolation step results in an increasing magnitude of the envelope in the upper band for the voiced sound "a" and in a generally constant magnitude frequency spectrum envelope in the upper band for the unvoiced sound "s". Thus after the interpolation step 1 the frequency spectrum of the wideband speech signal corresponds fairly closely to that of a true wideband speech signal in respect of the unvoiced sounds but not in respect of the voiced sounds.

As indicated above, after interpolation the narrowband speech signal is applied to the shape filter step 2, which shapes the spectrum of the wide-band speech signal to decrease with increasing frequency in order to more closely correspond with the spectrum of a true wide-band speech signal. In this way, the frequency spectrum of the voiced sounds in the interpolated wideband speech signal can be made to approximate the frequency spectrum of the voiced sounds in a true wideband speech signal.

However the spectrum of the interpolated wide-band speech signal corresponding to the unvoiced sounds is also filtered by the shape filter so as to decrease with increasing frequency. Clearly, in view of the frequency spectrum envelope of a true wide-band speech signal, this filtering of the unvoiced sound component is unwelcome.

In order to compensate for this unwelcome filtering of the unvoiced sound component by the shape filter, advantageously the dynamic compression of step 3*c* of FIG. 3 is applied to the upper band frequency spectrum corresponding to the unvoiced sound component. In general step 3*c* of FIG. 3 is arranged so as to limit the magnitude of input samples with large amplitudes and maintain the magnitude of input samples with smaller amplitudes. In this way the relative effect of larger amplitudes in the spectral envelope will be limited and the relative effect of smaller amplitudes will be enhanced. This effect can be achieved independently of whether the compressor works in time domain or frequency domain.

Finally, in order to further increase the intelligibility of the speech signal, the wide-band speech signal y output from the shaping step 2 or the wide-band speech signal z output from the compressing step 3 can be filtered with a non-linear function F(y), as shown in step 4 of FIG. 3. The filtering with a non-linear function is designed to estimate formants in the upper frequencies of the wide-band speech signal from the lower frequencies of the speech signal.

In addition, in accordance with embodiments of the invention the not-linear filtering step 4 may be carried out prior to the compression step 3, if appropriate (not shown in drawings).

It should, of course, be noted that any compressing step with similar functionality to the illustrative embodiment shown in FIGS. 3 and 4 may be used.

Furthermore, it should be noted that although the invention has been described with reference to FIG. 3 such that the compression is carried out after shaping, in fact compression can equally be carried out prior to filtering by the shape filter.

Thus in accordance with the present invention there is provided a method and signal processing means to expand the bandwidth of an input speech signal to generate a wide-band speech signal, which method is simple and easy to implement and gives acceptable speech quality.

The method of the present invention is particularly useful when implemented in the Digital Signal Processor of a mobile telephone.

What is claimed is:

1. A method to expand the bandwidth of an input speech signal, comprising the steps of converting an input speech signal sampled at a sampling rate N to a signal having a sample rate of 2N by outputting successive samples of the input signal as each alternate sample of the output signal and by outputting zero as the remaining alternate samples of the output signal; and filtering the signal output from the conversion means so as to shape the spectrum of that signal for frequencies between ¼ and ½ of its sample rate, to form a wide-band speech signal.

2. The method to expand the bandwidth of an input speech signal as claimed in claim 1 wherein the signal output from the conversion means is low pass filtered.

3. The method to expand the bandwidth of an input speech signal as claimed in claim 2 wherein the low-pass filtering is carried out using a FIR filter with a cut-off frequency at around ¼ of the sample rate of the wide-band speech signal.

4. The method to expand the bandwidth of an input speech signal as claimed in claim 1 also comprising the step of compressing the wide-band speech signal.

5. The method to expand the bandwidth of an input speech signal as claimed in claim 4, wherein the wide-band speech signal is filtered to obtain higher frequencies and the higher frequency signal components are compressed.

6. The method to expand the bandwidth of an input speech signal as claimed in claim 1, also comprising the additional step of filtering the wide-band speech signal with a non-linear function f(y) estimating the formants of the speech signal having frequencies between ¼ and 2 of its sample rate based on the frequency spectrum of the speech signal at frequencies less than ¼ of its sample rate.

7. The digital signal processor as claimed in claim 1 also comprising means for filtering the wide-band speech signal with a non-linear function f(y) to estimate the formants of the speech signal having frequencies between ¼ and 2 of its sample rate based on the frequency spectrum of the speech signal at frequencies less than ¼ of its sample rate.

8. A digital signal processor to expand the bandwidth of an input speech signal, comprising:

means to convert an input speech signal sampled at a sampling rate N to an output speech signal having a sample rate of 2N by outputting successive samples of the input signal as each alternate sample of the output signal and by outputting zero as the remaining alternate samples of the output signal; and filter means to shape the spectrum of the signal output from the conversion means for frequencies in the interval between ¼ and 2 of its sample rate, to form a wide-band speech signal.

9. The digital signal processor as claimed in claim 8 wherein the filter means is a low pass filter.

10. The digital signal processor as claimed in claim 9 wherein the low-pass filter is a FIR filter with a cut-off frequency at around ¼ of the sample rate of the wide-band speech signal.

11. The digital signal processor as claimed in claim 8 also comprising means for compressing the wide-band speech signal.

12. The digital signal processing means as claimed in claim 11 wherein the means for compressing the wide-band speech signal comprises means to filter the wide-band speech signal to obtain higher frequencies prior to compression of the higher frequency signal components.

13. The digital signal processor as claimed in claim 8, wherein the digital signal processor is incorporated into a telephone.

* * * * *

UNITED STATES PATENT AND TRADEMARK OFFICE

CERTIFICATE OF CORRECTION

PATENT NO. : 6,507,820 B1 
DATED : January 14, 2003
INVENTOR(S) : Petra Deutgen

It is certified that error appears in the above-identified patent and that said Letters Patent is hereby corrected as shown below:

Column 2,
Line 58, replace "Folded ($e^{j\omega}$)=Ispeech ($e^{j\omega}$)+Ispeech($e^{j(\omega-n)}$)" with -- Folded ($e^{j\omega}$) =Ispeech ($e^{j\omega}$)+Ispeech ($e^{j(\omega-\pi)}$) --

Column 3,
Line 3, replace "folded(n)=ispech(n)+(-11)" with -- folded(n)=ispeech(n)+(-1) --

Column 4,
Line 5, replace "wide-band' speech" with -- wide-band speech --
Line 9, replace "insteps 3a" with -- in steps 3a --

Column 6,
Line 17, replace "not-linear" with -- non-linear --
Line 48, replace "between ¼ and ½ of its sample rate," with -- between ¼ and 2 of its sample rate, --

Column 8,
Line 13, replace "The digital signal processing means" with -- The digital signal processor --

Signed and Sealed this

Ninth Day of March, 2004

JON W. DUDAS
*Acting Director of the United States Patent and Trademark Office*